US009846405B2

(12) United States Patent
Taguchi et al.

(10) Patent No.: US 9,846,405 B2
(45) Date of Patent: Dec. 19, 2017

(54) DEVELOPING CARTRIDGE COMPRISING MECHANISM FOR INFORMATION DETECTION

(71) Applicant: BROTHER KOGYO KABUSHIKI KAISHA, Nagoya-shi, Aichi-ken (JP)

(72) Inventors: Kazuna Taguchi, Nagoya (JP); Koji Abe, Nagoya (JP); Motoaki Mushika, Hashima (JP); Yasuo Fukamachi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/377,314

(22) Filed: Dec. 13, 2016

(65) Prior Publication Data

US 2017/0277117 A1 Sep. 28, 2017

(30) Foreign Application Priority Data

Mar. 28, 2016 (JP) ..... 2016-062964

(51) Int. Cl.
*G03G 15/00* (2006.01)
*G03G 21/16* (2006.01)
*G03G 15/08* (2006.01)

(52) U.S. Cl.
CPC ..... *G03G 21/1647* (2013.01); *G03G 15/0867* (2013.01)

(58) Field of Classification Search
CPC ..... G03G 15/0863; G03G 21/1875; G03G 21/1892; G03G 21/1896
(Continued)

(56) References Cited

U.S. PATENT DOCUMENTS 7,574,148 B2 * 8/2009 Igarashi et al. .... G03G 15/0822 399/12
8,090,272 B2 1/2012 Ishikawa
(Continued)

FOREIGN PATENT DOCUMENTS

EP 1 995 644 A2 11/2008
JP 2006-267994 A 10/2006
(Continued)

OTHER PUBLICATIONS

International Search Report and Written Opinion from corresponding International Application No. PCT/JP2016/087011, dated Jan. 31, 2017.
(Continued)

*Primary Examiner* — William J Royer
(74) *Attorney, Agent, or Firm* — Merchant & Gould P.C.

(57) ABSTRACT

A developing cartridge may include a housing including an outer surface, a small-diameter gear, a large-diameter gear, a first gear, and a moving member. The small-diameter gear may include a first engaging portion positioned on at least a portion of a peripheral surface of the small-diameter gear. The large-diameter gear may be positioned farther from the outer surface than the small-diameter gear from the outer surface. The large-diameter gear may be rotatable together with the small-diameter gear. The first gear may include a second engaging portion, a first end surface, a second end surface, and at least one protrusion. The moving member may include a contact portion configured to move the moving member from one position to another position in a state where the contact portion is in contact with the protrusion.

5 Claims, 6 Drawing Sheets

(58) Field of Classification Search
USPC ..... 399/12
See application file for complete search history.

(56) References Cited

U.S. PATENT DOCUMENTS

| | | | | |
|---|---|---|---|---|
| 8,600,244 | B2 * | 12/2013 | Hashimoto | G03G 15/0863 399/12 |
| 8,768,182 | B2 * | 7/2014 | Mushika et al. | G03G 21/1896 399/12 |
| 8,995,846 | B2 | 3/2015 | Itabashi et al. | |
| 9,020,370 | B2 * | 4/2015 | Itabashi et al. | G03G 15/0863 399/12 |
| 9,182,740 | B2 | 11/2015 | Shimizu | |
| 9,207,632 | B2 | 12/2015 | Itabashi et al. | |
| 9,535,396 | B2 | 1/2017 | Shimizu | |
| 2006/0193646 | A1 | 8/2006 | Suzuki et al. | |
| 2015/0277282 | A1 | 10/2015 | Taguchi | |
| 2016/0048093 | A1 | 2/2016 | Mushika et al. | |

FOREIGN PATENT DOCUMENTS

| | | | |
|---|---|---|---|
| JP | 2008-216392 | A | 9/2008 |
| JP | 2013-054063 | A | 3/2013 |
| JP | 2014-191210 | A | 10/2014 |
| JP | 2015-197531 | A | 11/2015 |

OTHER PUBLICATIONS

English translation of International Search Report and Written Opinion from corresponding International Application No. PCT/JP2016/087011, dated Jan. 31, 2017.
Extended European Search Report issued in related European application No. 17162950.4, dated Jul. 27, 2017.

* cited by examiner

DEVELOPING CARTRIDGE COMPRISING MECHANISM FOR INFORMATION DETECTION

CROSS REFERENCE TO RELATED APPLICATION

This application claims priority from Japanese Patent Application No. 2016-062964 filed Mar. 28, 2016.

The entire content of the priority application is incorporated herein by reference.

TECHNICAL FIELD

This present disclosure relates to a developing cartridge.

BACKGROUND

There has been known an image forming apparatus which a developing cartridge is attachable to and detachable from. The developing cartridge stores toner as a developing agent. This type of image forming apparatus determines whether the amount of toner in the developing cartridge decreases or whether the number of printed sheets exceeds a predetermined number. If determining that the amount of toner decreases or that the number of printed sheets exceeds the predetermined number, the image forming apparatus shows information on a display thereof to notify a user to change the developing cartridge. The user who has been noticed by the information on the display changes the developing cartridge to a new cartridge.

SUMMARY

There has also been known a developing cartridge that has a mechanism for detection of a new cartridge. When the developing cartridge is changed, the image forming apparatus detects whether the developing cartridge is new by motion of the mechanism. The movement for detection of new cartridge needs to be disposed in a small space while avoiding contacting other gears that transmit drive force to the movement.

The object of the disclosure is to provide a structure or configuration for detection of information about the developing cartridge while avoiding unnecessary contacts with other gears that transmit drive force to the movement.

It is therefore an object of the disclosure to provide a developing cartridge which may include a housing including an outer surface and configured to accommodate a developing agent, a small-diameter gear, a large-diameter gear, a first gear, and a moving member. The small-diameter gear may face the outer surface. The small-diameter gear may include a first engaging portion may be positioned on at least a portion of a peripheral surface of the small-diameter gear. The small-diameter gear may be rotatable about a first axis extending in an axial direction. The large-diameter gear may be positioned farther from the outer surface than the small-diameter gear from the outer surface. The large-diameter gear may be rotatable together with the small-diameter gear about the first axis. The first gear may be rotatable from a first position to a second position about a second axis different from the first axis. The first gear may include a second engaging portion may be positioned on at least a portion of a peripheral surface of the first gear. The second engaging portion may be configured to engage with at least portion of the first engaging portion. A first end surface may face the outer surface in the axial direction. A second end surface may be positioned opposite to the first end surface in the axial direction. The second end surface may be positioned away from the large-diameter gear. The second end surface may have a portion facing a portion of the large-diameter gear in the axial direction. The second end surface may be closer to the outer surface than the large-diameter gear to the outer surface. At least one protrusion may be positioned at the second end surface. A distal end portion of the protrusion may be away from the large-diameter gear in the axial direction. The protrusion may be rotatable together with the first gear. A portion of rotational locus of the protrusion may be overlapped with a portion of a rotational locus of the large-diameter gear in the axial direction when the first gear rotates from the first position to the second position. The moving member may be movable between a third position to a fourth position with respect to the housing. A portion of the housing may be farther from the outer surface than the large-diameter gear from the outer surface. The moving member may include a contact portion. The contact portion may be positioned outside of the rotational locus of the large-diameter gear. The contact portion may be in contact with the protrusion when the first gear rotates from the first position to the second position. The contact portion may be configured to move the moving member from the third position to the fourth position in a state where the contact portion is in contact with the protrusion.

BRIEF DESCRIPTION OF THE DRAWINGS

Figure 1:
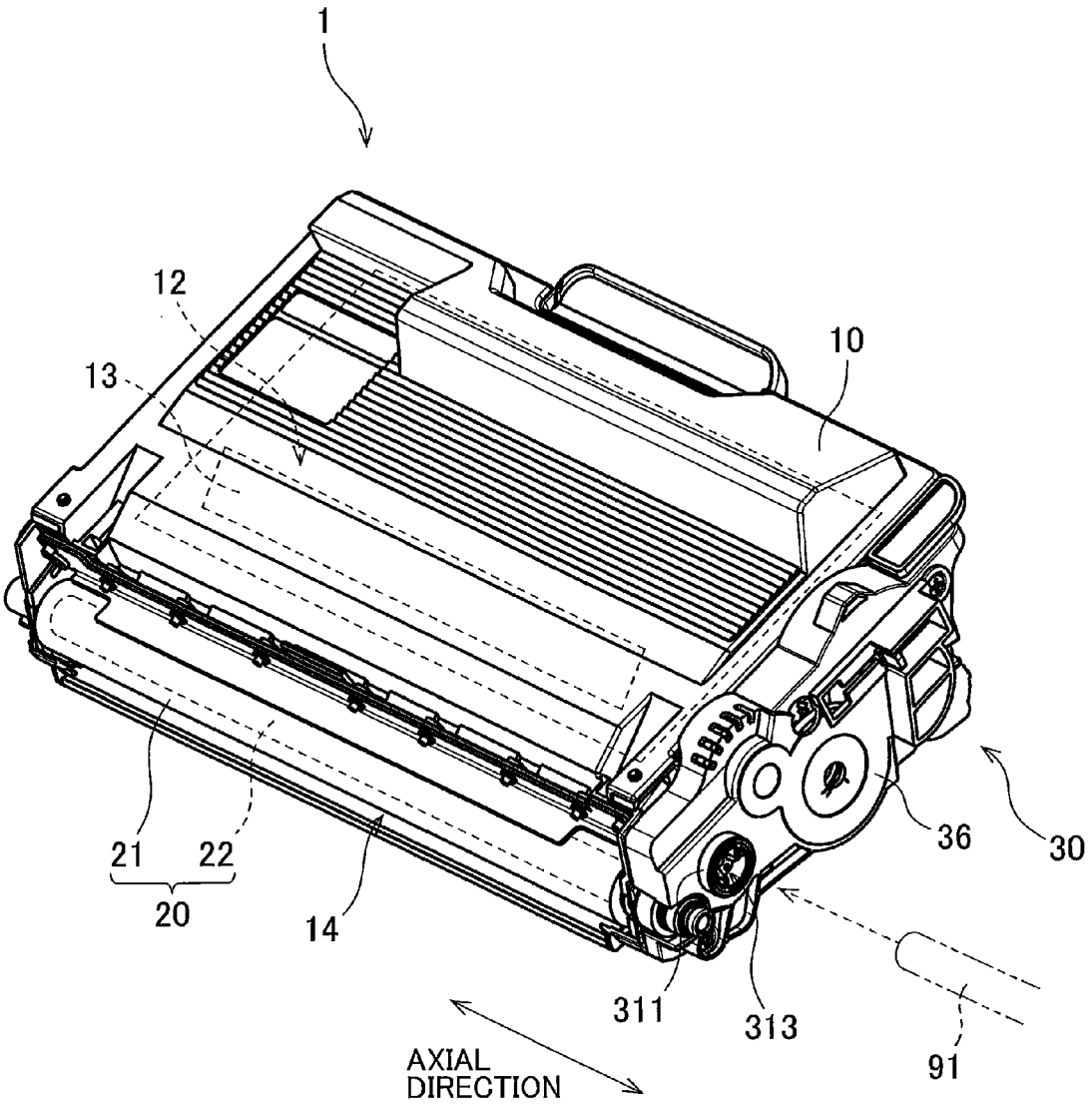
FIG. 1 is a perspective view of a developing cartridge according to an embodiment.

A developing cartridge 1 according to an embodiment will be described while referring to the accompanying drawings wherein like parts and components are designated by the same reference numerals to avoid duplicating description.

Figure 2:
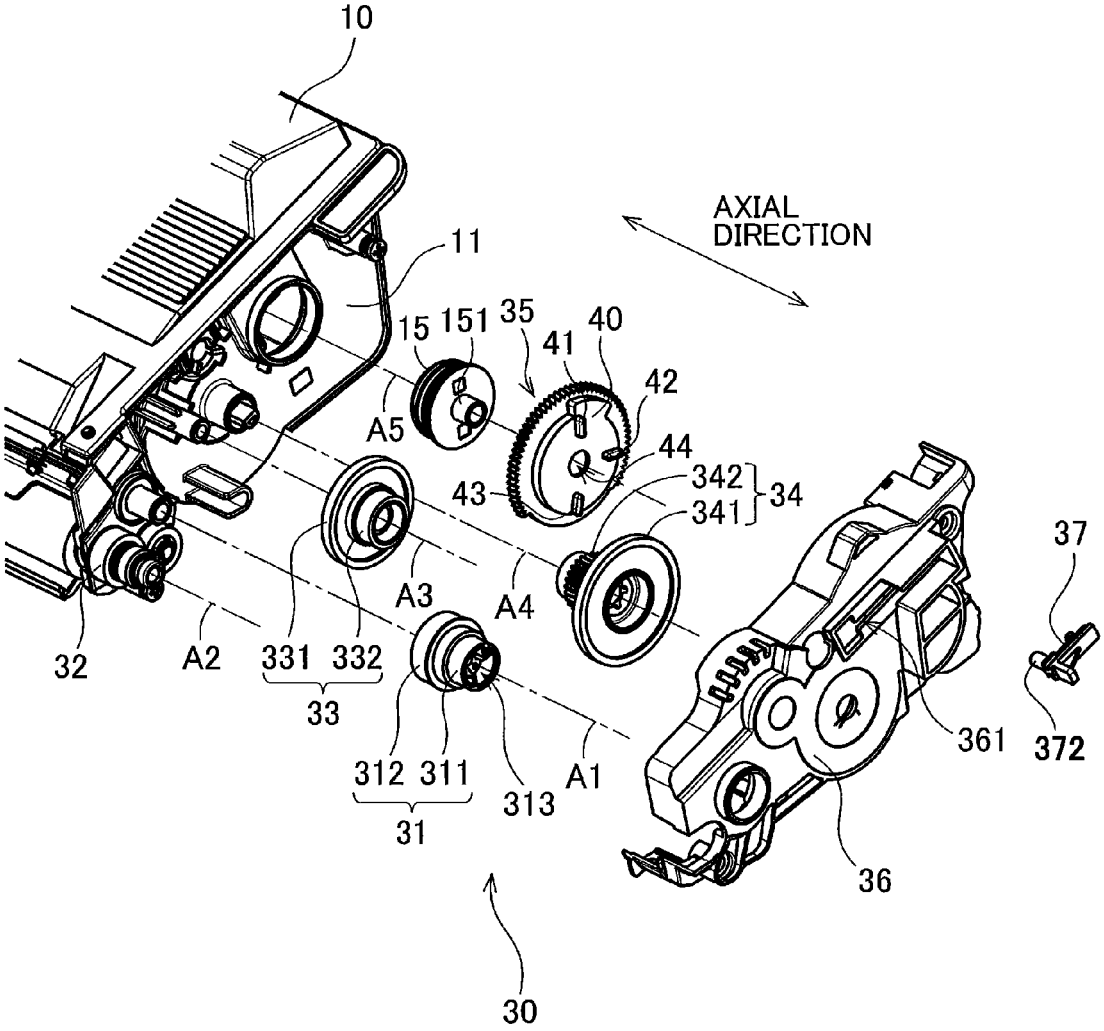
FIG. 2 is an exploded perspective view of a gear portion of the developing cartridge according to the embodiment.
Figure 4:
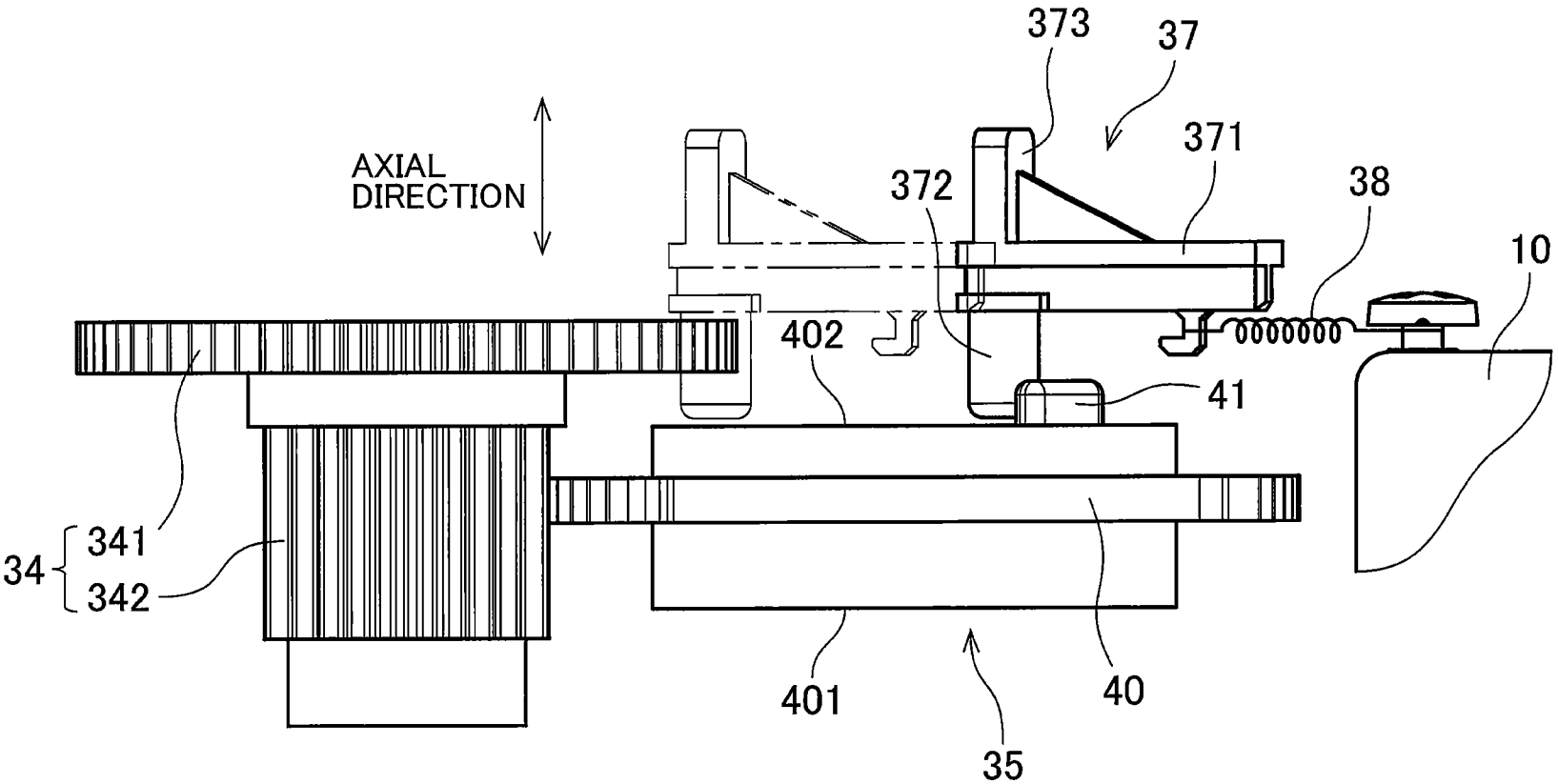
FIG. 4 is a side view of the agitator gear, the detection gear, and the moving member.

The terms "upward", "downward", "upper", "lower", "above", "below", "beneath", "right", "left", "front", "rear" and the like will be used throughout the description assuming that the developing cartridge 1 is disposed in an orientation in which it is intended to be used. In use, the developing cartridge 1 is disposed as shown in FIG. 1. The term "axial direction" will be used throughout the description assuming that a detection gear or a third gear has a rotation axis extending in the axial direction as illustrated in FIGS. 1, 2, and 4, i.e., extending direction of a first axis.

1. Configuration of Developing Cartridge

FIG. 1 illustrates a perspective view of the developing cartridge 1. The developing cartridge 1 is a unit configured to supply toner, as a developing agent, to a photo sensitive drum when attached to an image forming apparatus for electrophotography, e.g., a laser printer or LED printer. As illustrated in FIG. 1, the developing cartridge 1 includes a casing 10, a developing roller 20, and a gear portion 30.

The casing 10 is a housing or a casing to accommodate toner for electrophotography. The casing 10 has a first outer surface 11 at which the gear portion 30 is positioned (FIG. 2) and a second outer surface positioned opposite to the first outer surface 11. The casing 10 has a substantial cubic shape extending in the axial direction between the first outer surface 11 and the second outer surface. Inside the casing 10, a toner reservoir 12 to accommodate toner is provided. The casing 10 includes an agitator 13 extending in the axial direction inside the toner reservoir 12. The agitator 13 is mounted to an agitator gear 34, described later, so that the agitator 13 can rotate together with the agitator gear 34. The rotation of the agitator 13 agitates the toner inside the toner reservoir 12 to reduce cohesion of the toner inside the toner reservoir 12.

The developing roller 20 is a roller that can rotate about a rotational axis extending in the axial direction. The developing roller 20 includes a roller body 21 and a roller shaft 22. The roller body 21 is a cylindrical member extending in the axial direction. The roller body 21 is made from an elastic material, e.g., rubber. The roller shaft 22 has a substantial circular columnar shape penetrating the roller body 21 in the axial direction. The roller shaft 22 is made from metal or resin that has electrical conductivity. The roller body 21 is mounted to the roller shaft 22 so as not to rotate with respect to the roller shaft 22, and the roller body 21 can rotate together with the roller body 21.

Incidentally, the roller shaft 22 may not penetrate the roller body 21 in the axial direction. For example, a pair of the roller shaft 22 may individually extend in the axial direction from both axial ends of the roller body 21.

The casing 10 has the toner reservoir 12 and an opening 14 communicating the toner reservoir 12 and outside the toner reservoir 12. The roller body 21 is positioned at the opening 14 so as to extend in the axial direction. The roller shaft 22 has a first end portion and a second end portion in the axial direction and the first end portion is mounted to a developing gear 32 so as not to rotate with respect to the developing gear 32, which will be described later. Accordingly, the roller shaft 22 can rotate together with the developing gear 32, and the developing roller 20 can rotate together with the roller shaft 22.

When the image forming apparatus is operated, toner is supplied to an outer peripheral surface of the developing roller 20 from the toner reservoir 12 of the casing 10 via a supply roller, not illustrated. The toner is charged by triboelectric charging between the supply roller and the developing roller 20. Meanwhile, bias voltage is applied to the roller shaft 22, and the toner is therefore biased to the outer peripheral surface of the roller body 21 by the electrostatic force exerted on the toner by the roller shaft 22.

The developing cartridge 1 includes a doctor blade, which is not illustrated, for regulating thickness of the toner on an outer peripheral surface of the roller body 21 by removing extra toner. Accordingly, the outer peripheral surface of the roller body 21 after passing the doctor blade has a uniform thickness of toner. The toner on the outer peripheral surface of the roller body 21 is supplied to the photosensitive drum disposed in the image forming apparatus. The toner is transferred onto the photosensitive drum in accordance with an electrostatic latent image on the external surface of the photosensitive drum. Accordingly, the toner forms a visible toner image corresponding to the electrostatic latent image on the external surface of the photosensitive drum.

The gear portion 30 is positioned at the first outer surface 11 of the casing 10. The gear portion 30 includes a plurality of gears and a gear cover 36 that covers at least part of the plurality of gears. The plurality of gears include a coupling 311, described later. When the developing cartridge 1 is attached to the image forming apparatus, a drive shaft 91 is connected to the coupling 311. The drive shaft 91 supplies a drive force, and the drive force is transmitted to the agitator 13 and the developing roller 20 via the plurality of gears of the gear portion 30.

2. Structure of Gear Portion

Following describes the structure of the gear portion 30. The gear portion 30 includes a coupling 31, a developing gear 32, an idling gear 33, an agitator gear 34, a detection gear 35, a gear cover 36, and a moving member 37 as illustrated in FIG. 1 and FIG. 2 that illustrates an exploded perspective view of the gear portion 30. The coupling 31, the developing gear 32, the idling gear 33, the agitator gear 34, and the detection gear 35 rotate about rotation axes extending in the axial direction, respectively.

Note that FIG. 2 omits illustrations of gear teeth, except for the detection gear 35 and a small-diameter gear 342 of the agitator gear 34, which will be described later.

The coupling 31 receives the drive force firstly from the image forming apparatus. The coupling 31 can rotate about a rotation axis A1 extending in the axial direction. The coupling 31 includes a coupling 311 and a coupling gear 312. The coupling 311 and the coupling gear 312 are integrally formed of resin, for example. The coupling 311 has a fixing hole 313 that recesses in the axial direction. The coupling gear 312 has an outer peripheral portion including gear teeth, and the gear teeth of the coupling gear 312 are positioned at even intervals in the circumferential direction.

When the developing cartridge 1 is attached to the image forming apparatus, the drive shaft 91 is inserted into the fixing hole 313 of the coupling 311 such that the drive shaft 91 and the coupling 311 are connected to each other so as not to rotate relative to each other. Accordingly, the coupling 311 is rotatable together with the drive shaft 91, and the coupling gear 312 is rotatable together with the coupling 311.

The developing gear 32 is a gear for rotating the developing roller 20. The developing gear 32 is rotatable about a rotation axis A2 extending in the axial direction. The developing gear 32 has an outer peripheral portion including a plurality of gear teeth at even intervals along the whole circumferential dimension of the developing gear 32. The gear teeth of the coupling gear 312 and the gear teeth of the developing gear 32 are engaged with each other, and the developing gear 32 is mounted to the first end portion of the roller shaft 22 of the developing roller 20 so as not to rotate with respect to the roller shaft 22. That is, the roller shaft 22 is rotatable together with the developing gear 32. Accordingly, the developing gear 32 is rotatable together with the coupling gear 312, and the developing roller 20 is rotatable together with the developing gear 32.

The idling gear 33 is a gear for transmitting the rotation of the coupling gear 312 to the agitator gear 34. The idling gear 33 is rotatable about a rotation axis A3. The idling gear 33 includes an input gear 331 and an output gear 332, which are arrayed along the rotation axis A3. The input gear 331 and the output gear 332 are integrally formed and made of resin, for example. The distance between the output gear 332 and the first outer surface 11 is greater than that between the first outer surface 11 and the input gear 331. The output gear 332 has a diameter larger than that of the input gear 331.

The input gear 331 has an outer peripheral portion including a plurality of gear teeth at even intervals along its whole circumferential dimension, and the output gear 332 has a circumferential surface including a plurality of gear teeth at even intervals along its whole circumferential dimension. The gear teeth of the coupling gear 312 and the gear teeth of the input gear 331 are engaged with each other, and the gear teeth of the output gear 332 and the gear teeth of a large-diameter gear 341 of the agitator gear 34, described later, are engaged with each other. The input gear 331 is rotatable together with the coupling gear 312, and the output gear 332 is rotatable together with the input gear 331. The agitator gear 34 is rotatable in accordance with the rotation of the output gear 332.

The agitator gear 34 is a gear for rotating the agitator 13 in the toner reservoir 12. The agitator gear 34 is rotatable about a rotation axis A4 or the first axis A4, which extends in the axial direction. The agitator gear 34 has a large-diameter gear 341 and a small-diameter gear 342 arrayed along the first axis A4. The large-diameter gear 341 and the small-diameter gear 342 are integrally formed and made from resin, for example. The small-diameter gear 342 has a diameter smaller than that of the small-diameter gear 342. The large-diameter gear 341 is positioned farther from the first outer surface 11 than the large-diameter gear 341 is from the first outer surface 11. That is, the distance between the first outer surface 11 and the small-diameter gear 342 in the axial direction is smaller than that between the first outer surface 11 and the large-diameter gear 341 in the axial direction. The agitator gear 34 is an example of a second gear.

The large-diameter gear 341 has a circumferential portion provided with a plurality of gear teeth at even intervals along its whole circumferential dimension, and the small-diameter gear 342 has a circumferential portion provided with a plurality of gear teeth at even intervals along the whole circumferential dimension. As described above, the gear teeth of the output gear 332 and the gear teeth of the large-diameter gear 341 are engaged with each other, and the agitator gear 34 is mounted to the first end portion of the agitator 13 so as not to rotate relative to the agitator 13. Accordingly, the agitator 13 is rotatable together with the agitator gear 34. When the drive force is transmitted to the agitator gear 34 from the coupling 31 via the idling gear 33, the large-diameter gear 341 rotates and the small-diameter gear 342 also rotates upon the rotation of the large-diameter gear 341. The agitator 13 rotates in accordance with the rotation of the agitator gear 34.

The detection gear 35 is a gear for transmitting toward the image forming apparatus necessary information such as specifications of the developing cartridge 1. The detection gear 35 is an example of a first gear. The detection gear 35 is rotatable about a rotational axis or a second axis A5 extending in the axial direction. The first axis A4 and the second axis A5 extend in parallel at different positions. The detection gear 35 has a circumferential portion, and gear teeth are provided on part of the circumferential portion. When a new developing cartridge 1 is attached to the image forming apparatus, the detection gear 35 engages with the small-diameter gear 342 of the agitator gear 34 so that the detection gear 35 rotates. When the detection gear 35 is disengaged from the small-diameter gear 342, detection gear 35 stops its rotation.

The gear cover 36 is fixed on the first outer surface 11 of the casing 10 by screws, for example. At least one of the coupling 31, the developing gear 32, the idling gear 33, the agitator gear 34, and the detection gear 35, has a portion positioned between the first outer surface 11 and the gear cover 36. The fixing hole 313 of the coupling 311 is exposed outside of the gear cover 36. The gear cover 36 has a support hole 361, which is a slit-shaped thorough hole. The support hole 361 penetrates the gear cover 36 in the axial direction, and extends in a direction crossing the axial direction.

The moving member 37 can move in accordance with the rotation of the detection gear 35 and contact with a detection lever 92, which will be described later. The moving member 37 is supported by the support hole 361 of the gear cover 36. The moving member 37 has a portion positioned outside of the gear cover 36, and the other portion is positioned inside of the gear cover 36. The moving member 37 moves along the support hole 361 in the direction crossing the axial direction. Details of the moving member 37 will be described later.

3. Agitator Gear, Detection Gear, and Moving Member

Figure 3:
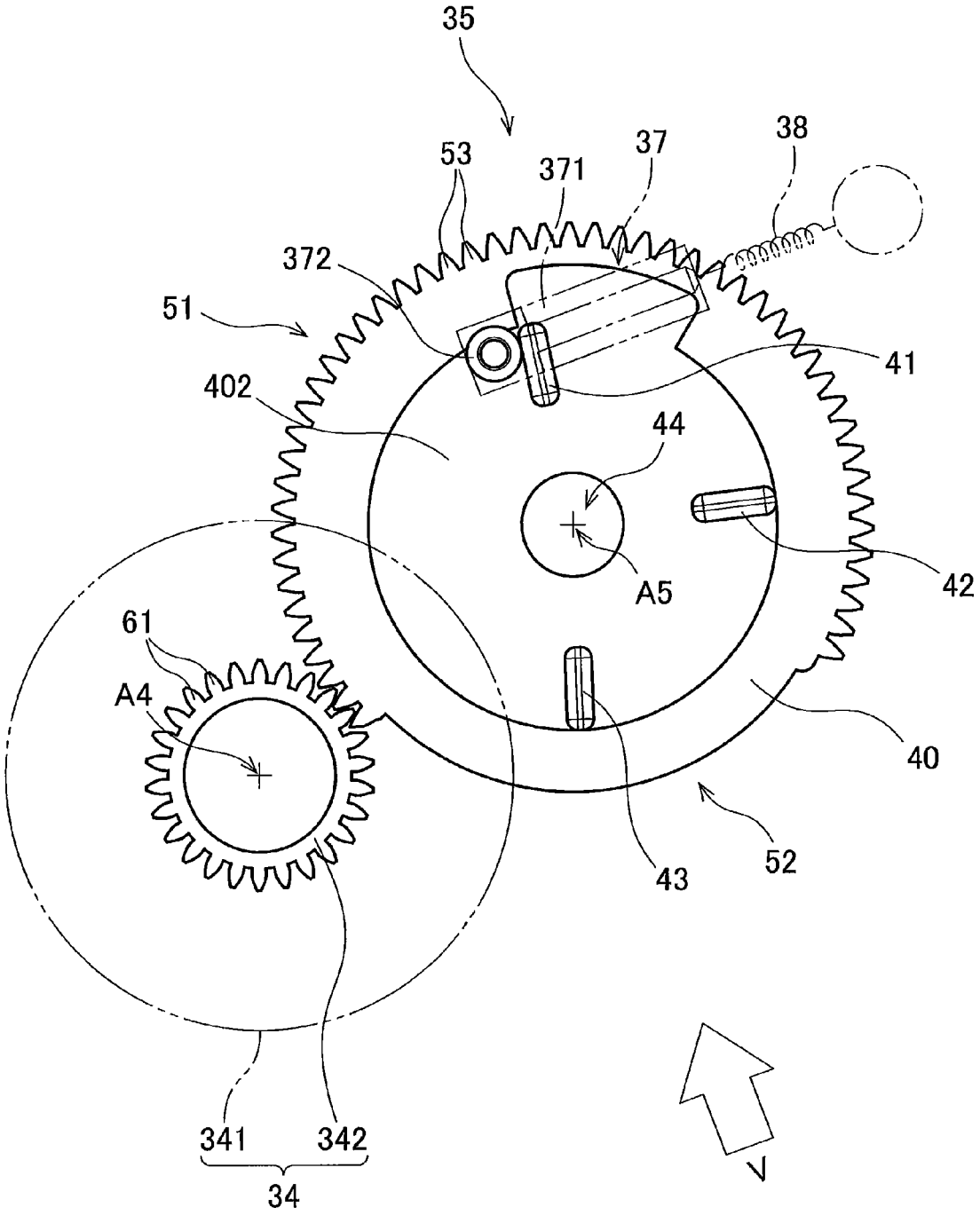
FIG. 3 is a plan view of an agitator gear, a detection gear, and a moving member according to the embodiment.

FIG. 3 is a plan view of the agitator gear 34, the detection gear 35, and the moving member 37, and FIG. 4 is a side view of the agitator gear 34, the detection gear 35, and the moving member 37 in the direction of a white arrow V in FIG. 3.

The detection gear 35 includes a disk portion 40, a first protrusion 41, a second protrusion 42, and a third protrusion 43. Note that the second protrusion 42 and the third protrusion 43 are omitted in the FIG. 4. The disk portion 40, the first protrusion 41, the second protrusion 42, and the third protrusion 43 are integrated and made from resin, for example. Note that the detection gear 35 may be formed by a plurality of materials, and the detection gear 35 may be made from materials other than resin.

The disk portion 40 is a plate-shaped portion orthogonal to the second axis A5. The disk portion 40 is closer to the first outer surface 11 than the large-diameter gear 341 is to the first outer surface 11. The disk portion 40 has a first end face 401 and a second end face 402, which are both faces of the disk portion 40. In other words, the first end face 401 and the second end face 402 are positioned opposite to each other with respect to the disk portion 40 in the axial direction. The first end face 401 faces the first outer surface 11 of the casing 10 in the axial direction, and the second end face 402 faces an inner face of the gear cover 36 in the axial direction. The large-diameter gear 341 has a portion that is away from part of the second end face 402 in the axial direction and is positioned between the disk portion 40 and the gear cover 36.

The disk portion 40 has an outer peripheral portion divided into a first region 51 and a second region 52. The first region 51 and the second region 52 are arrayed in a circumferential direction of the disk portion 40, which is a rotating direction of the disk portion 40 rotatable about the second axis A5. The disk portion 40 includes a plurality of gear teeth 53 only in the first region 51. That is, the disk portion 40 includes the plurality of gear teeth 53 only on part of the outer peripheral portion thereof. The gear teeth 53 are arrayed at even intervals in the circumferential direction. The plurality of gear teeth 53 is one example of a second engaging portion.

The small-diameter gear 342 includes a plurality of gear teeth 61 on its circumferential portion. The plurality of gear teeth 61 is an example of a first engaging portion. The plurality of gear teeth 61 has a portion inside of a circumscribed circle of the plurality of gear teeth 53 that has a center approximately coincident with the rotation axis A4, and the plurality of gear teeth 61 and the plurality of gear teeth 53 are therefore capable of engaging with each other.

Part of the plurality of gear teeth 53 engages or contacts with the plurality of gear teeth 61 in a new or unused developing cartridge 1.

The second region 52 of the disk portion 40 is recessed toward the second axis A5 from the circumscribed circle of the gear teeth 53, and is closer to the second axis A5 than the first region 51 is to the second axis A5. The second region 52 plots a locus when the disk portion 40 rotates, and the plurality of gear teeth 61 are positioned outside of the locus made by the second region 52. Hence, the gear teeth 61 of the small-diameter gear 342 and the second region 52 of the disk portion 40 do not engage with or contact with each other.

The disk portion 40 has a through hole 44 in its center portion. At the first outer surface 11 of the casing 10, a cap member 15 is fixed as illustrated in FIG. 2. The cap member 15 includes a support shaft 151 protruding toward the detection gear 35. The support shaft 151 is inserted into the through hole 44 of the disk portion 40. The detection gear 35 is supported by the support shaft 151 so as to rotate about the second axis A5. Alternatively, instead of the cap member 15, the casing 10 may have the support shaft 151 protruding directly from the first outer surface 11. Further, instead of the cap member 15, a shaft member that has the support shaft 151 may be fixed at the first outer surface 11.

Each of the first protrusion 41, the second protrusion 42, and the third protrusion 43 protrudes toward the gear cover 36 from the second end face 402. The first protrusion 41, the second protrusion 42, and the third protrusion 43 are separated from each other in the rotating direction of the detection gear 35. The first protrusion 41, the second protrusion 42, and the third protrusion 43 rotate about the second axis A5 together with the disk portion 40, when the detection gear 35 rotates.

The moving member 37 includes a main portion 371, a contact portion 372, and a detection projection 373. The main portion 371, the contact portion 372, and the detection projection 373 are integrally formed and made from resin, for example. The main portion 371 has a slit-shaped engaging groove. The engaging groove can engage with an edge portion of the support hole 361. Accordingly, the moving member 37 is supported by the gear cover 36 movably in a direction crossing the axial direction.

The contact portion 372 extends in the axial direction toward the casing 10 from the main portion 371. The contact portion 372 is positioned between the main portion 371 and the disk portion 40, as illustrated in FIG. 4. The contact portion 372 has an end positioned closer to the first outer surface 11 than the large-diameter gear 341 is to the first outer surface 11. The end portion of the contact portion 372 is positioned closer to the first outer surface 11 than any end portion of the first protrusion 41, the second protrusion 42, and the third protrusion 43 is to the first outer surface 11. The first protrusion 41, the second protrusion 42, and the third protrusion 43 define a circumscribed circle centered on the second axis A5, and the contact portion 372 has a portion that is positioned inside of the circumscribed circle. Accordingly, each of the first protrusion 41, the second protrusion 42, and the third protrusion 43 contacts with the contact portion 372, when the detection gear 35 rotates.

The detection projection 373 extends toward outside of the gear cover 36 from the main portion 371 in the axial direction. The detection projection 373 extends in a direction opposite to the protruding direction of the contact portion 372 that is parallel to the axial direction. The main portion 371 and the detection projection 373 are positioned farther from the first outer surface 11 than the large-diameter gear 341 from the first outer surface 11. When the contact portion 372 moves in the direction crossing the axial direction, the main portion 371 and the detection projection 373 move together with the contact portion 372 in the direction crossing the axial direction.

The gear portion 30 includes a coil spring 38 that is an example of an elastic member or resilient member. The coil spring 38 has first and second end portions. The first end portion is connected to the casing 10, and the second end portion is connected to the main portion 371 of the moving member 37. The coil spring 38 can expand and contract in the moving direction of the moving member 37, and the coil spring 38 exerts an elastic force on the moving member 37 whose quantity corresponds to the position or moving distance of the moving member 37.

4. Motion after Attachment of Developing Cartridge

Following describes motion of the detection gear 35 and the moving member 37 immediately after a new developing cartridge 1 is attached to the image forming apparatus. In the following description, the position of the detection gear 35 before starting the rotation is defined as "first position," and the position of the detection gear 35 that has rotated is defined as "second position." Further, the initial position of the moving member 37 is defined as "third position," and the position opposite to the third position in the moving range of the moving member 37 is defined as "fourth position."

When the coupling 31 receives the drive force, the coupling 31 transmits the drive force to the detection gear 35 via the idling gear 33 and the agitator gear 34. The detection gear 35 then starts rotating from the first position to the second position by engaging with the small-diameter gear 342. The first protrusion 41, the second protrusion 42, and the third protrusion 43 start rotating about the second axis A5 in accordance with the rotation of the detection gear 35.

Figure 5:
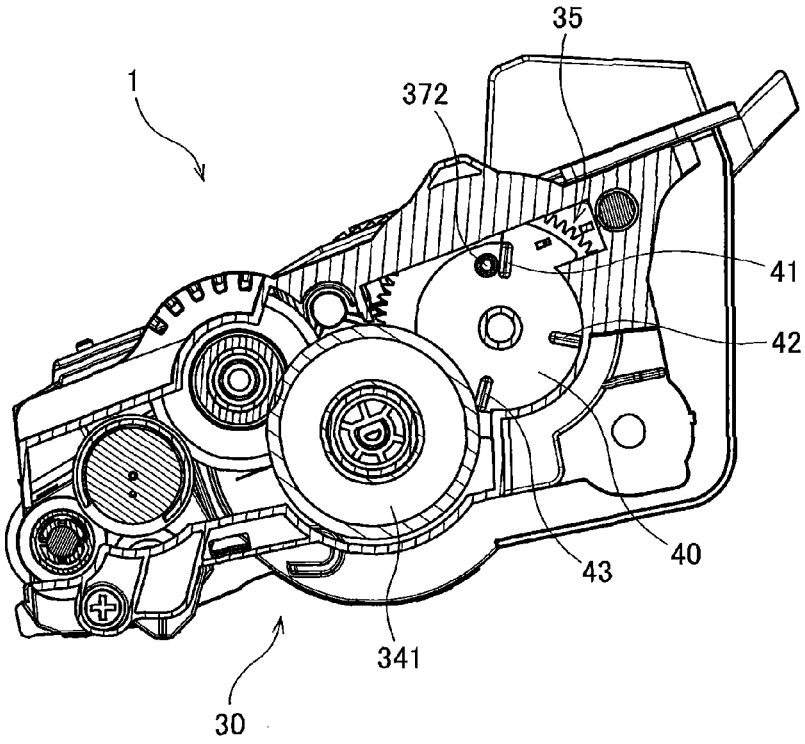
FIG. 5 is a cross-sectional view of a gear portion according to the embodiment in a state where a first protrusion contacts a contact portion.
Figure 6:
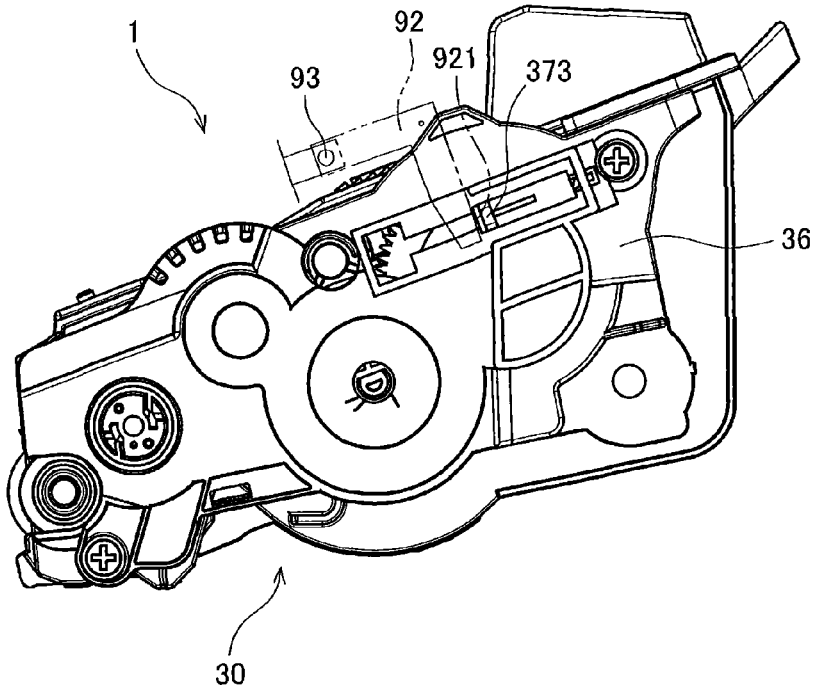
FIG. 6 is a plan view of the gear portion in a state where the first protrusion contacts the contact portion.

When the detection gear 35 is rotated by an angle of predetermined degrees, the first protrusion 41 firstly contacts with the contact portion 372 of the moving member 37. FIGS. 5 and 6 illustrate the gear portion 30 in the moment when the first protrusion 41 contacts with the contact portion 372. FIG. 5 illustrates a cross section of the gear portion 30 that is perpendicular to the axial direction, and FIG. 6 illustrates the exterior of the gear portion 30. The moving member 37 in the moment is at the third position.

Figure 7:
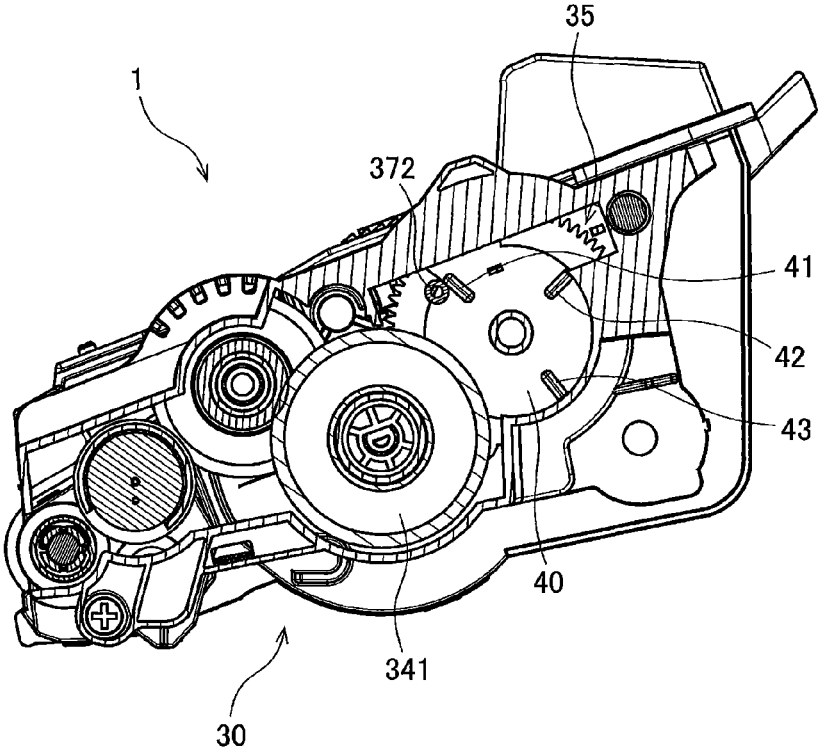
FIG. 7 is a cross-sectional view of the gear portion at a fourth position.
Figure 8:
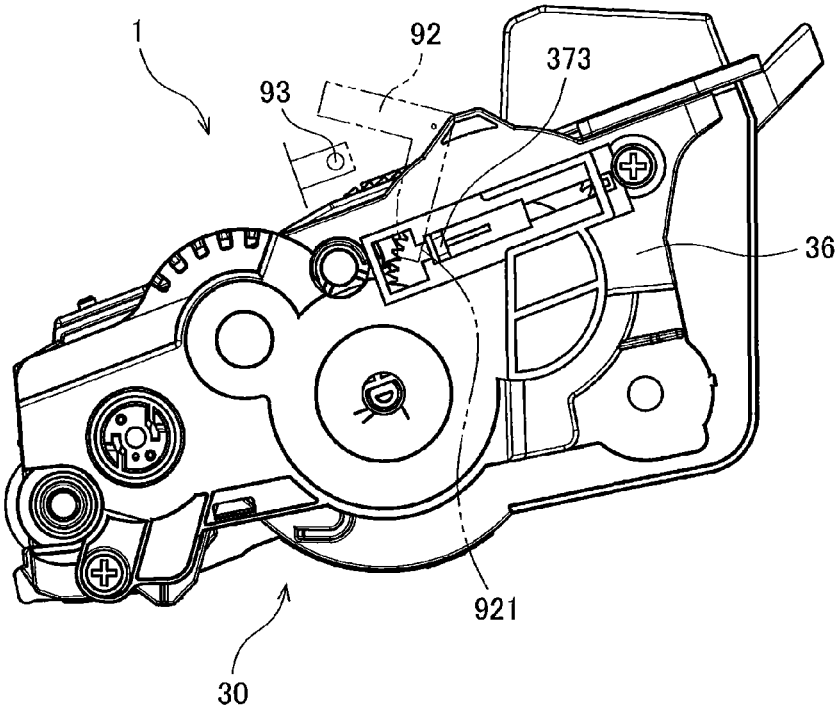
FIG. 8 is a plan view of the gear portion at the fourth position.

When the detection gear 35 is further rotated, the first protrusion 41 presses the contact portion 372. The moving member 37 slidingly moves to the fourth position from the third position. FIGS. 7 and 8 illustrate the gear portion 30 in the moment when the moving member 37 is displaced to the fourth position. FIG. 7 illustrates a cross section of the gear portion 30 that is perpendicular to the axial direction, and FIG. 8 illustrates the exterior of the gear portion 30. The length of the coil spring 38 in a state where the moving member 37 is at the fourth position is longer than that in a state where the moving member 37 is at the third position.

When the detection gear 35 is further rotated, the first protrusion 41 separates from the contact portion 372. The moving member 37 returns from the fourth position to the third position by the elastic force of the coil spring 38.

The second protrusion 42 then contacts with and presses the contact portion 372. The moving member 37 therefore slidingly moves to the fourth position from the third position. The second protrusion 42 separates from the contact portion 372, and the moving member 37 returns to the third position from the fourth position. The third protrusion 43 thereafter contacts with and presses the contact portion 372. The moving member 37 slidingly moves to the fourth position from the third position. Accordingly, the third protrusion 43 is separated from the contact portion 372, and the moving member 37 returns to the third position from the fourth position.

As described above, the first protrusion 41, the second protrusion 42, and the third protrusion 43 sequentially contacts with the contact portion 372, according to the disclosure. The contact portion 372 repeats three times the movement in which the contact portion 372 moves to the fourth position from the third position and then returns to the third position. When the detection gear 35 rotates to the second position, the detection gear 35 and the small-diameter gear 342 are disengaged from each other. Accordingly, the transmission of the drive force from the agitator gear 34 to the detection gear 35 is interrupted, and the detection gear 35 stops rotating.

As indicated by dash-dot-dot lines in FIGS. 6 and 8, the image forming apparatus includes a detection lever 92 and a sensor 93. The detection lever 92 is rotatable about a rotation axis extending in the axial direction. The detection lever 92 includes a contact face 921 that contacts with the detection projection 373. When the moving member 37 moves to the fourth position from the third position, the contact face 921 also changes its position. Accordingly, the detection lever 92 rotates to a sixth position from a fifth position. The detection lever 92 returns to the fifth position from the sixth position when the moving member 37 returns from the fourth position to the third position.

The sensor 93 detects the position change of the detection lever 92 that is movable between the fifth position and the sixth position. The sensor 93 may be chosen from various types of sensor, and for example, one of a light sensor, a magnetic sensor, and a contact sensor may be used as the sensor 93. The sensor 93 detects signals when the detection lever 92 is positioned at the fifth position and at the sixth position, and the signal corresponding to the fifth position is different from that corresponding to the sixth position. The signals from the sensor 93 therefore correspond to the motion of the moving member 37 in which the moving member 37 moves to the fourth position from the third position and then returns to the third position. The image forming apparatus acquires information about the developing cartridge 1 on the basis of the signals from the sensor 93. The information about the developing cartridge 1 includes information that the developing cartridge 1 is new and information about the specification of the developing cartridge 1, e.g., the amount of toner, the number of printable sheets, and the like.

According to the disclosure, the moving member 37 of the developing cartridge 1, which is an independent member separated from the detection gear 35, moves in accordance with the rotation of the first protrusion 41, the second protrusion 42, and the third protrusion 43 of the detection gear 35. The information about the developing cartridge 1 is transmitted to the image forming apparatus upon the motion of the moving member 37.

Each of the first protrusion 41, the second protrusion 42, and the third protrusion 43 is positioned adjacent to the large-diameter gear 341, and the moving member 37 is positioned outside of the locus constructed by the rotation of the large-diameter gear 341. Accordingly, the moving member 37 does not contact with the large-diameter gear 341.

The large-diameter gear 341 has a portion that is overlapped with portions of the first protrusion 41, the second protrusion 42, and the third protrusion 43 in the axial direction when the detection gear 35 rotates from the first position to the second position. Meanwhile, each end portion of the first protrusion 41, the second protrusion 42, and the third protrusion 43 is separated from the large-diameter gear 341. Accordingly, the first protrusion 41, the second protrusion 42, and the third protrusion 43 do not contact with the large-diameter gear 341.

As described above, the large-diameter gear 341, the first protrusion 41, the second protrusion 42, and the third protrusion 43 are positioned in the small space while avoiding contact with each other.

5. Modification

While the description has been made in detail with reference to specific disclosure thereof, it would be apparent to those skilled in the art that various changes and modifications may be made therein without departing from the spirit and scope of the above described disclosure.

According to the disclosure, the detection gear includes three protrusions, i.e., the first, second, and third protrusions. Alternatively, the detection gear may include protrusions less than three, or more than four. The protrusions may have shapes different from each other. The number, the positions, and the length in the circumferential direction of the protrusions may be changed in accordance with the specification of the developing cartridge.

The first to third protrusions extend in the axial direction from the disk portion, according to the disclosure. Alternatively, the protruding direction may be set in a direction other than the axial direction. For example, the detection gear may have a column portion extending along the second axis and a protrusion extending radially outward from the column potion. The first to third protrusions may be individual members that are connected to the disk portion.

The moving member is slidingly moved from the third position to the fourth position by being pressed by the protrusion. Alternatively, the moving member may be configured to be rotated from the third position to the fourth position by being pressed by the protrusion. According to the disclosure, the moving member is moved in the direction crossing the axial direction by being pressed by the protrusion. Alternatively, the moving member may be configured to be moved in the axial direction by being pressed by the protrusion.

Further, according to the disclosure, the plurality of gears engage with each other by the engagement of the gear teeth. Alternatively, the plurality of gears in the gear portion may be configured to engage with each other by the friction therebetween. For example, instead of the gear teeth, the detection gear may have a friction member, e.g., rubber, provided on its outer peripheral portion so that the friction member can contact with the small gear to engage with the agitator gear. The friction member may be made from a material that has a friction coefficient greater than that of the outer peripheral portion of the second region, favorably. Further, the agitator gear may have the friction member on its outer peripheral portion, instead of gear teeth.

According to the disclosure, position of the detection lever in the image forming apparatus is changed by being pressed by the moving member, and the sensor detects the position change of the detection lever. Alternatively, the sensor in the image forming apparatus may be configured to detect the position change of the moving member itself, instead of the position of the detection lever.

According to the disclosure, the second gear is the agitator gear, and alternatively, the second gear may be a gear other than the agitator gear. For example, the second gear may have a large gear and a small gear that are idle gears disconnected from the agitator.

According to the disclosure, the coil spring is used as the elastic member. Alternatively, instead of the coil spring, a flat spring, a torsion spring, resin having elasticity, and the like may be used as the coil spring.

Detail of the developing cartridge in the disclosure may be changed from the figures in the disclosure. Further, it will be appreciated by a man skilled in the art that each of the elements in the disclosure and the modification may be combined without departing from the scope of the disclosure.

What is claimed is:

1. A developing cartridge comprising:

a housing including an outer surface, the housing configured to accommodate a developing agent;

a small-diameter gear facing the outer surface, the small-diameter gear including a first engaging portion positioned on at least a portion of a peripheral surface of the small-diameter gear, the small-diameter gear being rotatable about a first axis extending in an axial direction;

a large-diameter gear positioned farther from the outer surface than the small-diameter gear from the outer surface, the large-diameter gear being rotatable together with the small-diameter gear about the first axis;

a first gear rotatable from a first position to a second position about a second axis different from the first axis, the first gear comprising:

a second engaging portion positioned on at least a portion of a peripheral surface of the first gear, the second engaging portion being configured to engage with at least portion of the first engaging portion;

a first end surface facing the outer surface in the axial direction;

a second end surface positioned opposite to the first end surface in the axial direction, the second end surface being positioned away from the large-diameter gear, the second end surface having a portion facing a portion of the large-diameter gear in the axial direction, the second end surface being closer to the outer surface than the large-diameter gear to the outer surface; and at least one protrusion positioned at the second end surface, a distal end portion of the protrusion being away from the large-diameter gear in the axial direction, the protrusion being rotatable together with the first gear, wherein a portion of rotational locus of the protrusion is overlapped with a portion of a rotational locus of the large-diameter gear in the axial direction when the first gear rotates from the first position to the second position; and a moving member movable between a third position to a fourth position with respect to the housing, a portion of the housing being farther from the outer surface than the large-diameter gear from the outer surface, the moving member further including:

a contact portion positioned outside of the rotational locus of the large-diameter gear, the contact portion being in contact with the protrusion when the first gear rotates from the first position to the second position, the contact portion being configured to move the moving member from the third position to the fourth position in a state where the contact portion is in contact with the protrusion.

2. The developing cartridge according to claim 1, wherein the first gear comprises a plurality of the protrusion, the plurality of the protrusion being separated from each other in the rotating direction.

3. The developing cartridge according to claim 1, further comprising a gear cover covering at least a portion of the first gear, the gear cover movably supporting the moving member.

4. The developing cartridge according to claim 1, further comprising an elastic member configured to move the moving member from the fourth position to the third position.

5. The developing cartridge according to claim 1, wherein the moving member is movable in a direction crossing the axial direction.

* * * * *